United States Patent [19]

Nuding et al.

[11] 4,311,973

[45] Jan. 19, 1982

[54] WAVEGUIDE JUNCTION

[75] Inventors: Erich Nuding, Auenwald; Gerhard Hirsch, Backnang, both of Fed. Rep. of Germany

[73] Assignee: Licentia Patent-Verwaltungs GmbH, Frankfurt am Main, Fed. Rep. of Germany

[21] Appl. No.: 957,005

[22] Filed: Nov. 2, 1978

[30] Foreign Application Priority Data

Nov. 2, 1977 [DE] Fed. Rep. of Germany ..... 27489561

[51] Int. Cl.[3] ..... H01P 1/165

[52] U.S. Cl. ..... 333/33; 333/21 A; 333/257

[58] Field of Search ..... 333/21 A, 254, 256, 333/257, 33

[56] References Cited

U.S. PATENT DOCUMENTS

| | | | |
|---|---|---|---|
| 2,668,191 | 2/1954 | Cohen | 333/21 A |
| 2,709,242 | 5/1955 | Reed | 333/256 X |
| 2,729,794 | 1/1956 | Cohn | 333/21 A |
| 2,975,383 | 3/1961 | Seling | 333/21 A |

FOREIGN PATENT DOCUMENTS

| | | | |
|---|---|---|---|
| 491175 | 11/1975 | U.S.S.R. | 333/257 |

*Primary Examiner*—Paul L. Gensler

*Attorney, Agent, or Firm*—Spencer & Kaye

[57] ABSTRACT

A junction for connecting together two waveguides whose major transverse axes are inclined to one another, composed of elements connecting the frontal faces of the waveguides in such a manner that their major axes are adjustably inclined to one another, flanges covering the nonoverlapping frontal faces of the two waveguides, and reactance components disposed at the point of discontinuity produced by the angular offset between the waveguides for compensating for such discontinuity over a broad frequency band.

6 Claims, 6 Drawing Figures

WAVEGUIDE JUNCTION

BACKGROUND OF THE INVENTION

The present invention relates to a waveguide junction between waveguides which are arranged so that their major axes are inclined to one another.

For the transmission of data in the microwave range, antennas are used which generally have a preferred direction of polarization, e.g. they are linearly polarized horizontally or vertically. For technical reasons relating to transmission it is necessary to change the direction of polarization on directional transmission paths between relay link sections. Such change in polarization is of particular importance for mobile transmission systems. This can be easily accomplished with instruments having a coaxial antenna feeder system.

However, radio systems operating in the GHz range require, for the transmission without excessive attenuation, antenna feeds in the form of waveguides having crossectional shapes, for example rectangular or elliptical, which determine the vector position of the electrical field and thus the direction of polarization of the antenna radiation. For such radio devices it is now also desirable to be able to connect, in a simple manner, two orthogonally oriented line arrangements. In devices with a given polarization plane, a change in polarization can be effected only by modification with additional parts or by the use of rotatable waveguide sections, which involves correspondingly high costs.

SUMMARY OF THE INVENTION

It is an object of the present invention to provide a waveguide arrangement which easily permits rotation of the transmitted polarization direction without use of twistable waveguides and without additional parts. These and other objects are achieved, according to the invention, by provisions of a junction for connecting together two waveguides whose major transverse axes are inclined to one another, which junction is composed of elements connecting the frontal faces of the waveguides in such a manner that their major axes are adjustably inclined to one another, flanges covering the nonoverlapping frontal faces of the two waveguides, and reactance components disposed at the point of discontinuity produced by the angular offset between the waveguides for compensating for such discontinuity over a broad frequency band.

A particular embodiment of the invention covers a twist point as it is required in the course of a line or arrangement of components. Any twist angle required by the design of the device can be established. Conventional twisted waveguide sections are thus no longer required and are replaced in a simple manner by arrangements according to the invention.

DESCRIPTION OF THE PREFERRED EMBODIMENTS

Figure 1:
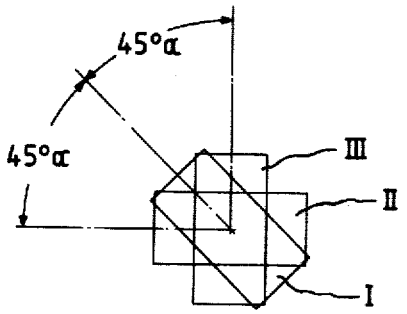
FIG. 1 is a schematic diagram illustrating the coupling between two waveguides.

FIG. 1 is a cross-sectional schematic representation of two coupled waveguides. The waveguide at position I may here be twisted or pivoted $\pm\alpha$ with respect to the cross section of the waveguide at position II or III.

Figure 2A:
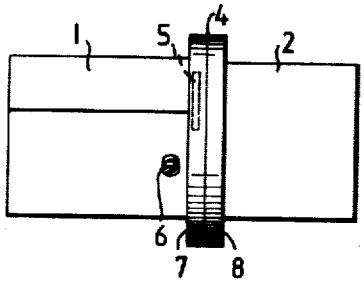
FIGS. 2*a* and 2*b* are side elevational and cross-sectional end views, respectively of a preferred embodiment of waveguide junction according to the invention.
Figure 2B:
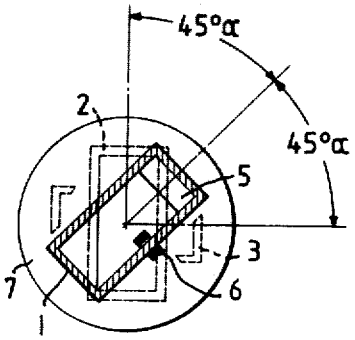

In FIGS. 2*a* and 2*b* an input, or incoming, waveguide is provided at its output end with a flange 7. A continuing waveguide 2 is disposed after waveguide 1 and is connected thereto via flange 8 at plane 4 in such a manner that its major axis forms an angle $\alpha$ with the major axis of the incoming waveguide 1. In the illustrated embodiment this angle is 45°. Waveguide 1 could also be connected to a continuing waveguide 3 whose major axis forms an angle with that of waveguide 1.

Flanges 7 and 8 of the abutting waveguides 1 and 2 are designed so that the nonoverlapping portions of the frontal faces of the two waveguides are covered by flange faces. Due to the angular offset between the two waveguides 1 and 2 by the angle $\alpha$ a point of discontinuity is created in the connecting plane 4. This point of discontinuity is, according to the invention, compensated over a broad frequency band by a reactance element 6 provided at this location. The precise dimensions of the reactance element can easily be determined empirically in dependence on the selected waveguide cross section. This cross section of the waveguide may be rectangular or elliptical.

The present invention also eliminates need for the twists which are required in antenna feeder lines or in the design of devices, even if they are other than 45°, and thus permits creation of simpler structural designs.

Figure 3A:
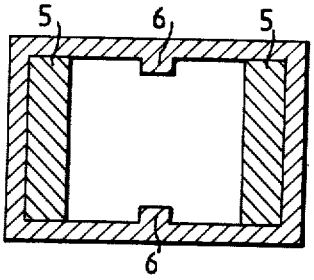
FIGS. 3*a* and 3*b* show a rectangular and an elliptical cross section of a waveguide provided with an inductive and a capacitive compensating reactance.
Figure 3B:
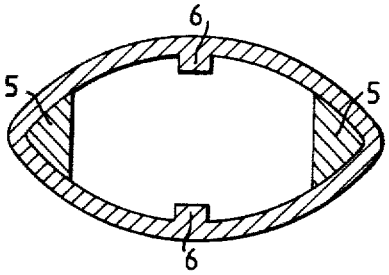

The components 5 and 6 represent compensating reactances, which are placed in waveguide 1 near the connection plane. FIGS. 3*a* and 3*b* show waveguides with rectangular and elliptical cross sections, respectively. Both of them have an inductive reactance 5 and a capacitive reactance 6, realized in known manner by shutters and stubs. In FIGS. 2*a* and 2*b* the capacitive reactance 6 is realized by one screw projecting into the waveguide.

This waveguide junction can be applied at all rectangular or elliptical waveguides especially with an aspect ratio or an axial ratio of approximately 1:2.

The dimension of the compensating reactances depends on the size of the cross section and on the angle, which is formed by the major axes of the two waveguides 1 and 2.

Either one of waveguides 1 or 2 shown in FIGS. 2*a* and 2*b*, can be an antenna feeder line.

It is to be understood that the above description of the present invention is susceptible to various modifications, changes and adaptations, and the same are intended to be comprehended within the meaning and range of equivalents of the appended claim.

What is claimed is:

1. A junction for connecting together two waveguides whose major transverse axes are inclined to one another, comprising: means connecting the frontal faces of said waveguides in such a manner that their major axes are adjustably inclined to one another; two flat flanges each connected to a respective waveguide and having flat faces coextensive over their entire extent with a common connecting plane at which said faces directly abut and which cover the nonoverlapping frontal faces of said two waveguides; and inductive and capacitive reactance means disposed at the point of discontinuity produced by the angular offset between said waveguides for compensating for such discontinuity over a broad frequency band.

2. An arrangement as defined in claim 1 wherein the major axes of said waveguides to be connected are inclined at an angle of 45° with one another.

3. An arrangement as defined in claim 1 wherein each of said waveguides has a rectangular cross section.

4. An arrangement as defined in claim 1 wherein each of said waveguides has an elliptical cross section.

5. An arrangement as defined in claim 1 wherein said flanges are circular flanges meeting at the connecting plane between said waveguides.

6. An arrangement as defined in claim 1 wherein one of said waveguides serves as an antenna feeder line.

* * * * *